US006413116B2

(12) United States Patent
Bechaz et al.

(10) Patent No.: US 6,413,116 B2
(45) **Date of Patent: *Jul. 2, 2002**

(54) INSULATION-DISPLACEMENT CONNECTION PIECE

(75) Inventors: Bernard Bechaz, Caluire; Christophe Graffin, Collonges au Mont d'Or, both of (FR)

(73) Assignee: Entrelec S.A., Villeurbanne (FR)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/370,629

(22) Filed: Aug. 6, 1999

(30) Foreign Application Priority Data

Aug. 7, 1998 (FR) ..... 98 10312

(51) Int. Cl.[7] ..... H01R 4/24
(52) U.S. Cl. ..... 439/406; 439/395
(58) Field of Search ..... 439/406, 417, 439/395

(56) References Cited

U.S. PATENT DOCUMENTS 3,902,154 A * 8/1975 McKee ..... 339/223 R
4,209,218 A * 6/1980 Kosten et al. ..... 439/395
RE31,132 E * 1/1983 Hoppe, Jr. ..... 439/406
4,414,740 A * 11/1983 Nijman ..... 29/751
4,776,812 A 10/1988 Boissonnet et al.
4,940,425 A * 7/1990 Hass et al. ..... 439/406
4,973,261 A * 11/1990 Hatagishi et al. ..... 439/406
5,022,867 A * 6/1991 Kourimsky et al. ..... 439/395
5,257,945 A * 11/1993 Heng et al. ..... 439/406
6,007,365 A * 12/1999 Atsumi et al. ..... 439/406

FOREIGN PATENT DOCUMENTS

| | | |
|---|---|---|
| DE | 2040805 | 2/1972 |
| EP | 0247360 | 4/1987 |
| EP | 0352905 | 1/1990 |
| FR | 2764125 | 12/1998 |
| GB | 2230389 | 10/1990 |

OTHER PUBLICATIONS

French Search Report dated Feb.16, 2001 (2pp).

* cited by examiner

*Primary Examiner*—Tho D. Ta
*Assistant Examiner*—Ann McCamey
(74) *Attorney, Agent, or Firm*—Ware, Fressola, Van Der Sluys & Adolphson LLP

(57) ABSTRACT

A connection piece includes a profiled part having a hollow polygonal cross section along which is made, longitudinally, a straight stripping and retaining slit (10) for at least one wire. The edges of the stripping and retaining slit (10) form the free edges of a part (12) bent over toward the inside of the hollow polygonal section. A connector for at least one electrical wire has such a connection piece as well as an insulating casing (4) provided with an oblong opening (24), which is approximately parallel to the slit and lies facing the latter, and with a housing (8) in which the conducting connecting piece (2) is immobilized.

15 Claims, 2 Drawing Sheets

INSULATION-DISPLACEMENT CONNECTION PIECE

TECHNICAL FIELD

The present invention relates to an insulation-displacement connection piece having a stripping and retaining slit for one or more electrical wires.

BACKGROUND OF THE INVENTION

Such a connection piece is made of a conducting material and is intended to be put into a casing made of an insulating material, for example a synthetic material. The casing is, for example, the casing of a terminal block. In this case, the connection piece is connected to another connection piece. The connection piece may also be incorporated into an electrical apparatus or machine and connect an external wire to an internal device.

DESCRIPTION OF THE PRIOR ART

Patent EP-0,247,360 describes a connection piece of this type. This conducting connection piece comprises a profiled part, having a hollow polygonal cross section, along which is made, longitudinally, a straight stripping and retaining slit for at least one wire.

The connection arrangement described in this European patent, and which comprises the connection piece described above, also provides for the casing housing the connection piece to have an opening which includes a straight slot for retaining the sheath which extends opposite the stripping and core-retaining slit. This slot allows the wire to be more firmly retained when an axial pulling force is exerted on the wire.

In order for the slit profiled part to be sufficiently rigid, it is necessary to have a relatively large thickness of material.

SUMMARY OF THE INVENTION

The object of the present invention is to provide a connection piece allowing sufficient retention of the wire without having to provide an additional retention slot. Advantageously, this connection piece will be rigid enough to allow the thickness of material used to be less than that of the connection pieces of the prior art.

For this purpose, the connection piece proposed by the invention is an insulation-displacement connection piece comprising a profiled part having a hollow polygonal cross section, along which is made, longitudinally, a stripping and retaining slit for at least one wire.

According to the invention, the edges of the stripping and retaining slit form the free edges of an inwardly bent-over part of the hollow polygonal section.

In this way, the retention of a connected wire is very substantially improved. It therefore becomes unnecessary to provide an additional retention slot.

Moreover, such a structure is more rigid than those of the prior art. It is therefore possible to use thinner materials while still achieving sufficient rigidity.

In a preferred embodiment, the profiled part carrying the slit has a cross section corresponding to a U, the free ends of which have been obliquely and equally bent over toward each other, through an angle greater than 90°, so as to make a space between them corresponding to the width of the slit. In this case, the free ends of the U-shaped section are advantageously bent over through an angle of between 120 and 150°.

The edges of the slit may be gradually thinned toward this slot, as is already known in the case of the connection pieces of the prior art.

For better introduction of the wire and better stripping of the latter, the slit may advantageously have a stripping mouth obtained by cutting, obliquely and symmetrically, the bent-over parts bordering the slit, at one end of the latter.

The invention also relates to a connector for at least one electrical wire, comprising a conducting connection piece with a stripping and retaining slit as well as an insulating casing provided with an oblong opening, which is approximately parallel to the slit and lies facing the latter, and with a housing in which the conducting connection piece is immobilized. According to the invention, this connector comprises a connection piece as described above.

In one embodiment, the casing also has an opening made in the extension of the profiled part of the connection piece and intended for the tip of an external tool to pass through it, said external tool being designed to allow a wire to be introduced into the stripping and retaining slit.

BRIEF DESCRIPTION OF THE DRAWINGS

In any case, the invention will be thoroughly understood from the description which follows, with reference to the appended diagrammatic drawing, illustrated by way of a nonlimiting example of a preferred embodiment of a connection piece and of a connector according to the invention.

DESCRIPTION OF THE PREFERRED EMBODIMENT

Figure 1:
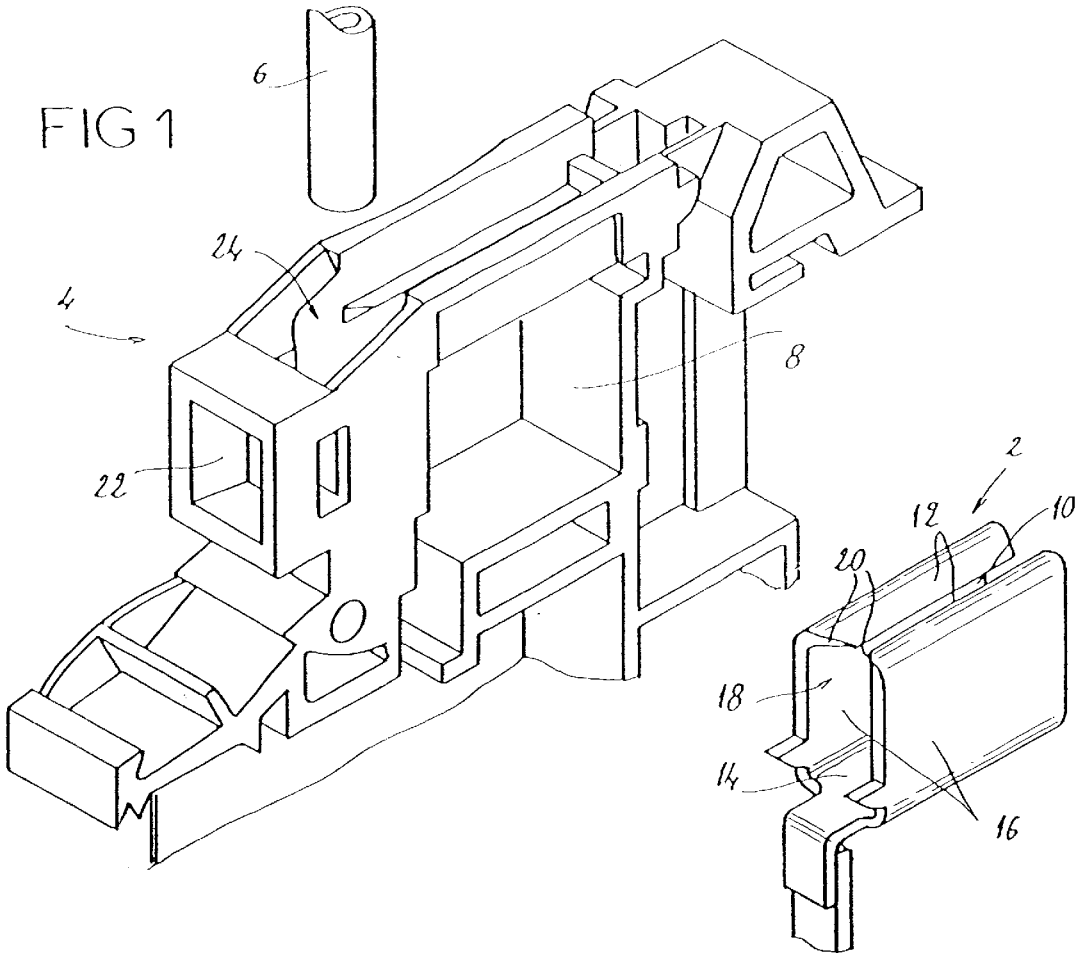
FIG. 1 is an exploded perspective view of a connector according to the invention.
Figure 3:
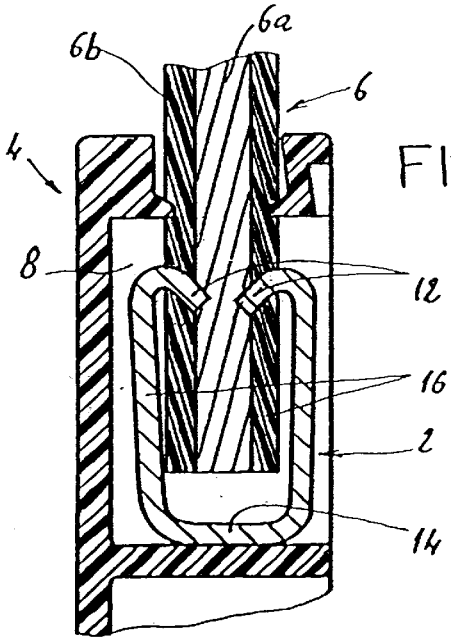
FIG. 3 corresponds to FIG. 2, and shows a wire having been introduced into the connection piece.

FIG. 1 illustrates a connection piece 2 according to the invention, a casing 4 intended to house the connection piece 2 and a wire 6 to be connected, which wire has a core 6*a* and a sheath 6*b* (see FIG. 3).

The casing 4 is an insulating casing made of a synthetic material. It has a housing 8 for the connection piece 2. The casing 4 illustrated is designed to be fastened to another similar casing, the bottom of which serves as a cover, thus closing the housing 8.

The connection piece 2 has a stripping and retaining slit 10, which in this case is straight. This slit 10 is made longitudinally along a profiled part of the piece 2. The latter is obtained, for example, from a flat blank by stamping, involving it being cut, bent and locally thinned.

The profiled part of the connection piece 2 has a hollow polygonal cross section, a vertex of which is reentrant, that is to say the sides of the polygon which lie on either side of this reentrant vertex are bent over toward the inside of the polygon. The angle between these two sides, measured outside the polygon, is less than 180°.

Figure 2:
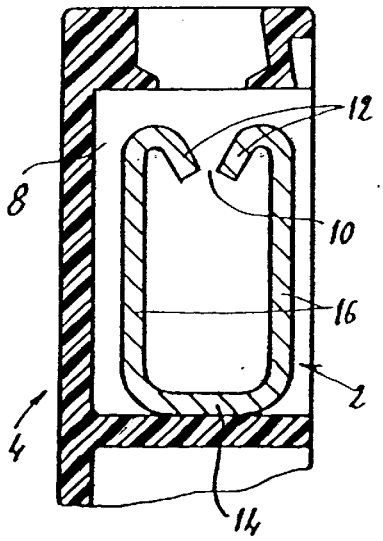
FIG. 2 is a top view showing a connection piece according to the invention.

In the example illustrated in the drawing (cf. FIG. 2), the cross section of the profiled part of the piece 2 corresponds to a U having a base 14 and branches 16, the free ends of which have each been bent over obliquely and equally through an angle greater than 90°, approximately 135°, so as to form a bent-over part 12 oriented toward the base 14 of the U. The free edges of these two bent-over parts 12 form the border of the slit 10 which they define.

The slit 10 has a stripping mouth 18 made at one of its ends. This mouth 18 is obtained by cutting, obliquely and symmetrically, the bent-over parts 12 at one of their ends. This stripping mouth 18 is flared and has two sharp edges 20 one at each oblique cut. The bent-over parts 12 are gradually thinned toward the sharp edges 20 so as to allow them to cut into the sheath 6*b* of a wire 6 introduced into the slot 10.

FIG. 3 shows the wire 6 when it is connected. The sheath 6*b* of the wire has been cut into and electrical contact is established between the core 6*a* of the wire and the edges of the bent-over parts 12 defining the slit 10.

Figure 4:
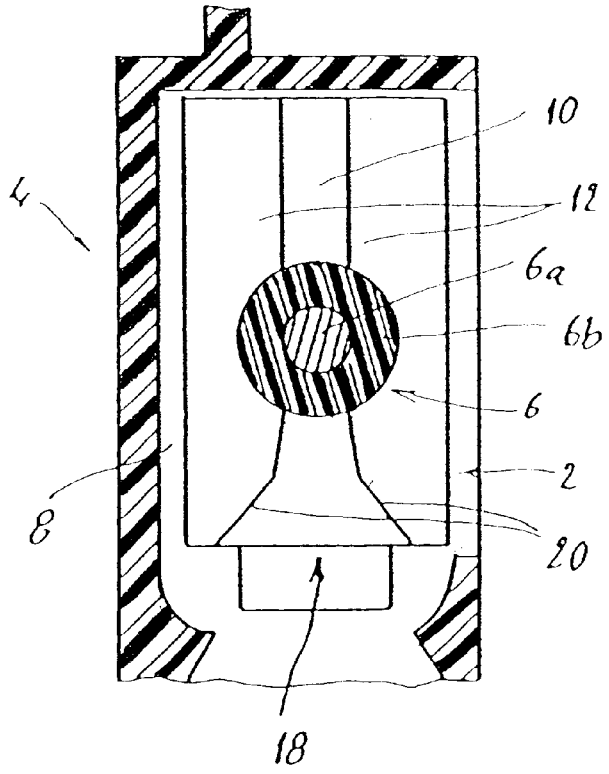
FIGS. 4 and 5 are views showing from the front, the connection piece with one connected wire and with two connected wires, respectively.
Figure 5:
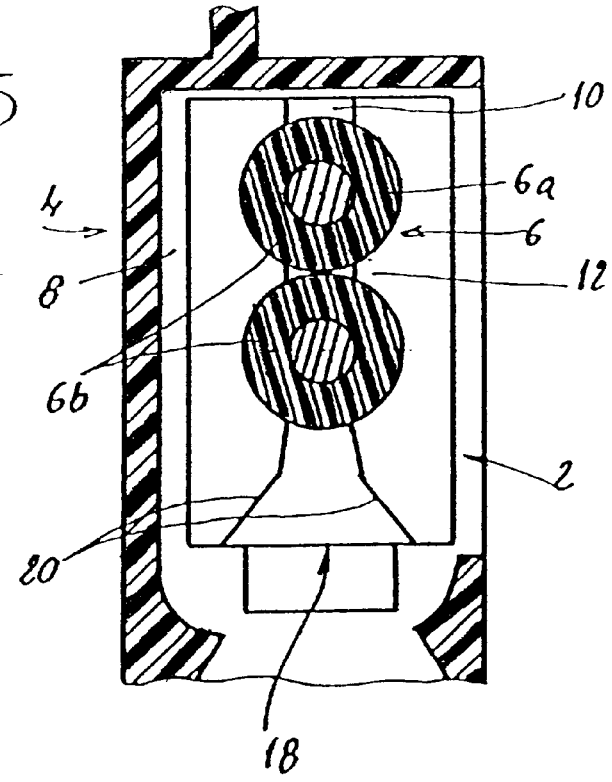

As shown in FIGS. 4 and 5, when the slit 10 is long enough, it is possible to connect one or two (or even more) wires in the slit 10.

In the exemplary embodiment illustrated in FIG. 1, the casing 4 has an opening 22, intended to allow the tip of a tool to pass through it and allowing the wire 6 to be introduced into the slit 10, (see FIG. 2) and an orifice 24 for allowing the wire 6 to be introduced from the outside into the stripping slit 10.

The opening 22 is placed in the extension of the profiled part of the connection piece 2, on the same side as the stripping mouth 18. It is intended to allow the tip of a tool to pass through it (not illustrated and not described in detail here). Reference should be made to Patent EP-0,247,360 or Patent EP-0,265,321 for the description of the tool and of its tip. The shape of the opening 22 is tailored to the shape of the tip of the tool.

The opening 24 faces the slit 10. It allows the electrical wire 6 above the stripping mouth 18 to be introduced and also allows the wire 6 to slide when the latter is pushed into the slit 10. This opening 24 is, for example, in the form of an oblong hole.

By virtue of the shape of the connection piece 2, it is unnecessary to provide rims at the opening 24 in order to jam the sheath 6*b* of the wire 6 and thus help to retain this wire. The casing 4 therefore has a simplified shape at the opening 24 compared with the casings of the prior art.

The shape of the connection piece 2 also makes it possible to achieve better rigidity compared with connection pieces of the prior art. Consequently, it is possible to reduce the thickness of the material used to make the connection piece. This allows the manufacturing cost of this piece to be considerably reduced.

Needless to say, the invention is not limited to the embodiment described above by way of nonlimiting example—on the contrary, it embraces all the variants thereof falling within the scope of the claims appended hereto.

Thus, for example, the shape of the profiled part, the slit and its mouth may be modified without departing from the scope of the invention.

The connection piece described above can also be used in a connector not requiring the use of a specific tool for introducing the wire between the edges of the stripping slit.

What is claimed is:

1. An insulation-displacement connection piece (2) for stripping and retaining at least one wire (6), the connection piece (2) comprising a profiled part having a hollow polygonal cross section, wherein the part has a base, and also has an opposite side along which is made, longitudinally, a stripping and retaining slit (10) receptive to at least one wire (6) situated prependicular to the slit, wherein the edges of the stripping and retaining slit (10) form the free distal cutting edges of parts (12) permanently bent over toward the inside and toward each other and toward the base of the hollow polygonal section, wherein the wire has a direction situated perpendicular to the slit, and wherein the distal cutting edges are situated and dimensioned so as to cut the at least one wire (6) to a metallic core of the at least one wire (6) situated perpendicular to the slit.

2. The connection piece (2) as claimed in claim 1, wherein the edges of the slit (10) are gradually thinned toward this slit.

3. The connection piece (2) as claimed in claim 1, wherein the slit has a stripping mouth (18) obtained by cutting, obliquely and symmetrically, the bent-over parts (12) bordering the slit, at one end of the latter.

4. The connection piece (2) as claimed in claim 1, wherein the profiled part carrying the slit (10) has a constant cross section corresponding to a U, the free distal ends of which have been obliquely and equally bent over toward each other, through an angle greater than 90° and less than 180°, so as to make a space between them corresponding to the width of the slit (10), wherein the base is located at a bottom of the U, wherein the U has only one slit (10), wherein the U has left and right sides that are substantially flat, wherein the profiled part has a slit length greater than any dimension of the U, and wherein the stripping and retaining slit is for accommodating a plurality of wires situated perpendicular to the slit.

5. The connection piece (2) as claimed in claim 1, wherein the profiled part carrying the slit (10) has a cross section corresponding to a U, the free ends of which have been obliquely and equally bent over toward each other, through an angle greater than 90°, so as to make a space between them corresponding to the width of the slit (10).

6. The connection piece (2) as claimed in claim 5, wherein the free ends of the U-shaped section have been bent over through an angle of between 120 and 150°.

7. The connection piece (2) as claimed in claim 6, wherein the edges of the slit (10) are gradually thinned toward this slit.

8. The connection piece (2) as claimed in claim 7, wherein the slit has a stripping mouth (18) obtianed by cutting, obliquely and symmetrically, the bent-over parts (12) bordering the slit, at one end of the latter.

9. A connector for at least one electrical wire (6), comprising a conducting connection piece (2) with a stripping and retaining slit (10) as well as an insulating casing (4) provided with an oblong opening (24), which is approximately parallel to the slit and lies facing the latter, and with a housing (8) in which the conducting connection piece (2) is immobilized, wherein the conducting connection piece comprises a profiled part having a hollow polygonal cross section along which is made, longitudinally, a stripping and retaining slit (10) for at least one wire (6), wherein the oblong opening (24) of the insulating casing (4) is dimensioned to require the wire to be introduced perpendicularly into the slit, and wherein the edges of the stripping and retaining slit (10) form the free edges of a part (12) bent over toward the inside of the hollow polygonal section.

10. The connection as claimed in claim 9, wherein the casing (4) also has an opening (22) made in the extension of the profiled part of the connection piece (2) and intended for the tip of an external tool to pass through it, said external tool being designed to allow a wire (6) to be introduced into the stripping and retaining slit (10).

11. The connector of claim 9, wherein the cross section is substantially constant at substantially any point along the slit.

12. A connector for at least one electrical wire (6), comprising a conducting connection piece (2) with a stripping and retaining slit (10) as well as an insulating casing (4) providing with an oblong opening (24), which is approximately parallel to the slit and lies facing the latter, and with a housing (8) in which the conducting connection piece (2) is immobilized;

wherein the conducting connection piece comprises a profiled part having a hollow polygonal cross section along which is made, longitudinally, a stripping and retaining slit (10) for at least one wire (6);

wherein the edges of the stripping and retaining slit (10) form the free edges of a part (12) bent over toward the inside of the hollow polygonal section;

further wherein the profiled part carrying the slit (10) has a cross section corresponding to a U, the free ends of which have been obliquely and equally bent over toward each other, through an angle of between 120 and 150° so as to make a space between them corresponding to the width of the slit (10);

wherein the oblong opening (24) of the insulating casing (4) is dimensioned to require the wire to be introduced perpendicularly into the slit;

wherein the edges of the slit (10) are gradually thinned toward this slit; and wherein the slit has a stripping mouth (18) obtained by cutting, obliquely and symmetrically, the bent-over parts (12) bordering the slit, at one end of the latter.

13. The connector of claim 12, wherein the cross section is substantially constant at substantially any point along the slit.

14. An insulation-displacement connection piece (2), comprising a profiled part having a hollow polygonal cross section, wherein the part has a base and also has an opposite side along which is made, longitudinally, a stripping and retaining slit (10) for at least one wire (6) situated perpendicular to the slit, wherein the edges of the stripping and retaining slit (10) form the free distal cutting edges of parts (12) permanently bent over toward the inside and toward each other and toward the base of the hollow polygonal section, wherein the slit has a length greater than any dimension of the cross section, and wherein the distal cutting edges are for cutting the at least one wire (6) to a metallic core of the at least one wire (6) situated perpendicular to the slit.

15. The insulation-displacement connection piece (2) of claim 14, wherein the cross section is substantially constant at substantially any point along the slit.

* * * * *

UNITED STATES PATENT AND TRADEMARK OFFICE

CERTIFICATE OF CORRECTION

PATENT NO. : 6,413,116 B2
DATED : July 2, 2002
INVENTOR(S) : B. Bechaz et al.

It is certified that error appears in the above-identified patent and that said Letters Patent is hereby corrected as shown below:

Title page,
Item [54], ABSTRACT,
Line 1, “includes” should be -- comprises --.

Column 4,
Line 51, “obtianed” should be -- obtained --.

Column 5,
Line 4, “connection” should be -- connector --.
Line 16, “providing” should be -- provided --.

Signed and Sealed this

Twenty-eighth Day of January, 2003

JAMES E. ROGAN
*Director of the United States Patent and Trademark Office*